United States Patent [19]

Jusseau et al.

[11] Patent Number: 4,466,682

[45] Date of Patent: Aug. 21, 1984

[54] TERMINAL BLOCK FOR ELECTRIC CONNECTION WITHOUT STRIPPING

[75] Inventors: Marcel Jusseau; André Borne, both of Villeurbanne; Gilbert Fermond, St-Pierre de Chandieu; Jéan P. Heng, Lyons, all of France

[73] Assignee: CGEE Alsthom, Levallois-Perret, France

[21] Appl. No.: 432,915

[22] PCT Filed: Apr. 1, 1982

[86] PCT No.: PCT/FR82/00064

§ 371 Date: Sep. 28, 1982

§ 102(e) Date: Sep. 28, 1982

[87] PCT Pub. No.: WO82/03501

PCT Pub. Date: Oct. 14, 1982

[30] Foreign Application Priority Data

Apr. 3, 1981 [FR] France ..... 81 06813

[51] Int. Cl.[3] ..... H01R 13/39

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 4,349,239 | 9/1982 | Roberts et al. | 339/97 R |
| 4,379,605 | 4/1983 | Hoffman | 339/97 P |
| 4,405,193 | 9/1983 | Weidler | 339/97 P |

*Primary Examiner*—Joseph H. McGlynn

*Attorney, Agent, or Firm*—Sughrue, Mion, Zinn, Macpeak and Seas

[57] ABSTRACT

A terminal block equipped with connection parts which avoid the necessity of stripping the connecting wires. The terminal block (1) has a groove (13) inside which is accommodated firstly at least one connection part (3) whose lips (30, 30') form an automatic stripping and blocking slot in the axis of the groove and secondly a pusher (2) which can be manipulated from the outside and can move in translation in the groove (13) between a partial interpenetration position with the part (3) and a position allowing the insertion of suitable wire (4) between said pushing piece and the part (3). The invention relates to electric connection and more particularly to the connection of energy distribution wires.

7 Claims, 8 Drawing Figures

TERMINAL BLOCK FOR ELECTRIC CONNECTION WITHOUT STRIPPING

FIELD OF THE INVENTION

The present invention relates to a terminal block for electric connection without stripping.

BACKGROUND OF THE INVENTION

It is well known to connect electric wires for low currents by means of metal connection parts which avoid the need for wire stripping by cutting the insulation themselves and ensuring contact with the conductor metal of the core of the wire.

In contrast, for higher currents, use has been made up till now of terminal blocks which require prior stripping of the insulation and which are more expensive and take longer to manufacture and to install.

The present invention provides a terminal block which allows electric power supply wires of usual diameter to be connected without being stripped and in a simple manner while allowing a series of lengths of conductors to be connected together properly due to a suitable shape whose great elasticity makes it possible to better master the contact pressure on the conductors.

SUMMARY OF THE INVENTION

In accordance with a characteristic of the invention, the terminal block has a groove which contains firstly at least one fixed and conductive connection part open towards the inside and set in the direction of the axis of the groove by a slot for stripping and locking the core of a conductor wire, secondly at least one sliding pusher which can be manipulated from the outside of the terminal block and can move in translation along the longitudinal axis of the groove between a position of partial interpenetration within the part bearing the blocking and stripping slot and a position which allows the insertion of a suitable wire between itself and the opening of the slot, so as to allow the core to be inserted by force in the slot when the pusher is returned to the interpenetration position under the action of an outside manipulating force.

Other features and advantages of the invention will be defined during the description and in relation with the following figures.

DESCRIPTION OF PREFERRED EMBODIMENTS

Figure 1:
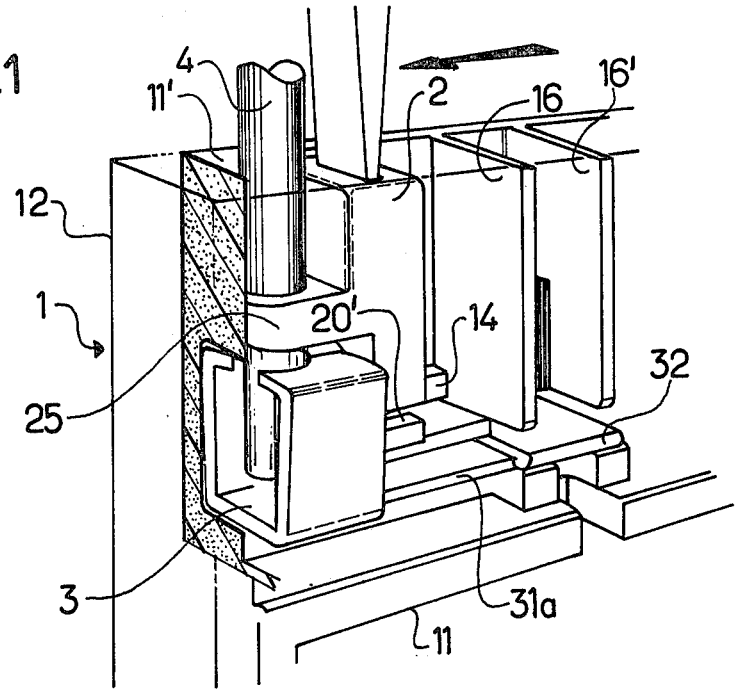
FIGS. 1 and 2 are perspective views as partial cross-sections of the same terminal block in accordance with the invention, in two states.
Figure 3:
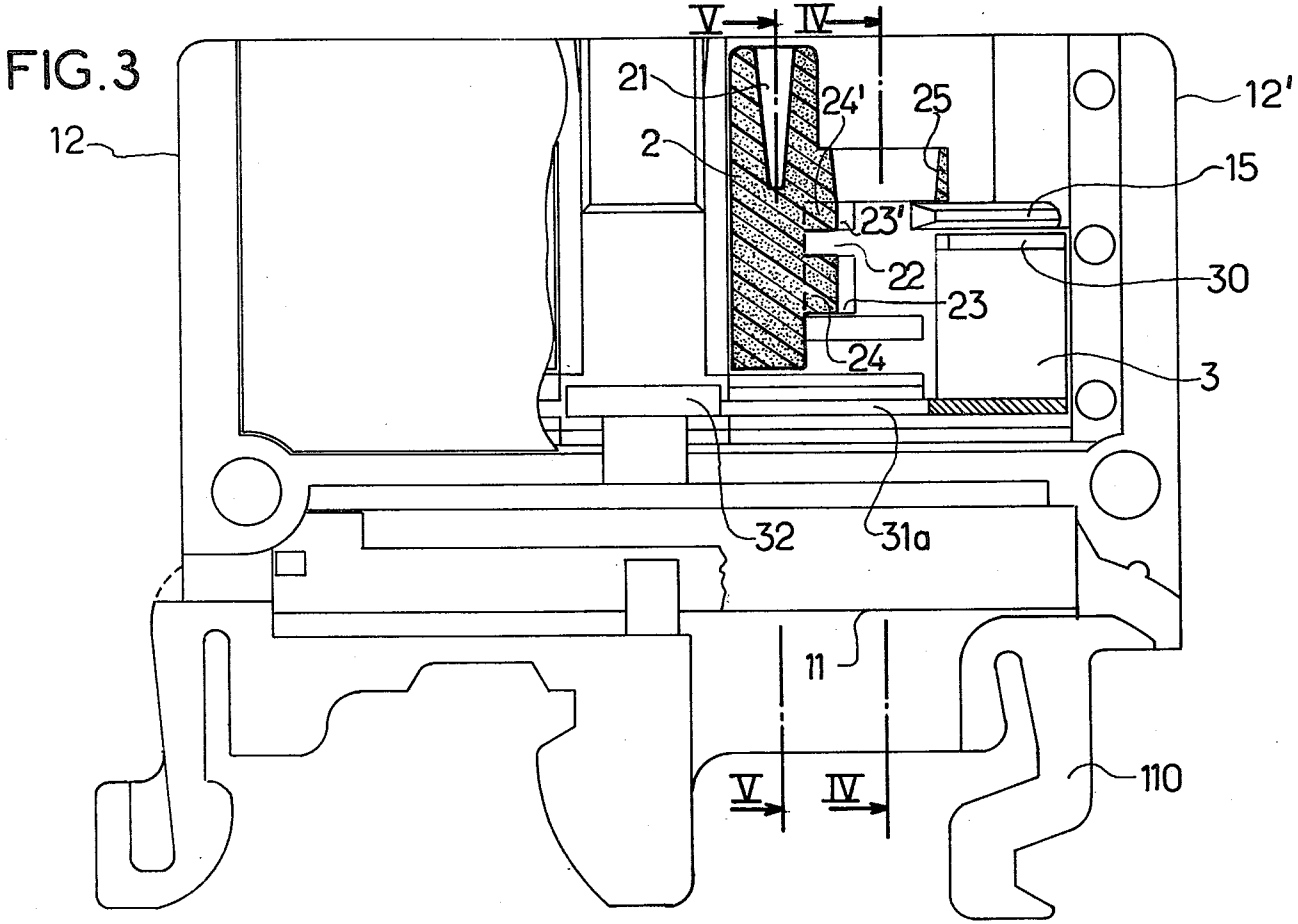
FIG. 3 is a partial cross-section seen from the side of the terminal block illustrated in FIGS. 1 and 2.
Figure 4:
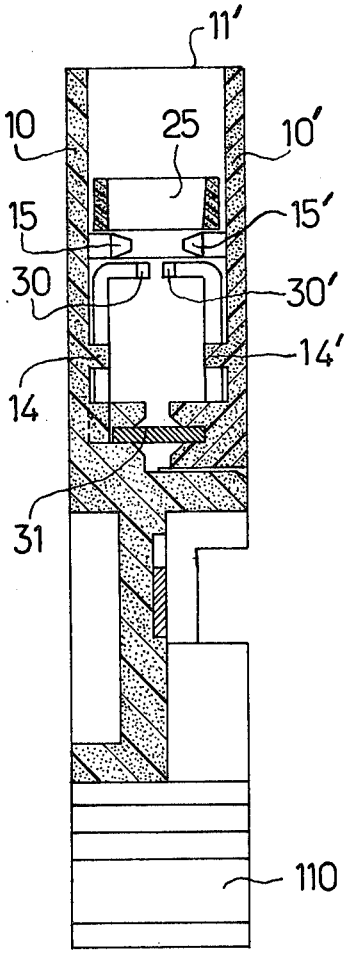
FIG. 4 and FIG. 5 are partial side cross-sections along line IV—IV and along line V—V of the terminal block illustrated in FIG. 3.
Figure 5:
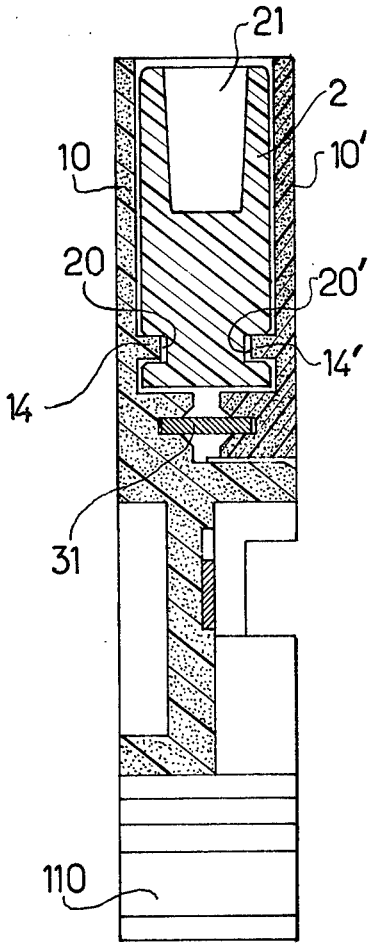

The terminal block illustrated in FIG. 1 is conventionally composed of a housing 1 whose outside shape, outlined here, is shown more clearly in FIGS. 3, 4 and 5.

Said housing 1 has a conventional, roughly parallelepipedical, rectangular shape with two large side faces 10,10' (FIG. 4) and four walls 11, 11' 12, 12'. The wall 11, forms the bottom of the block 1 and supports fixing means 110 (FIG. 3). The wall 11' forms the top of the block 1 and is normally accessible and visible when the block 1 is grouped together with other blocks on a support.

The walls 12 and 12' (FIG. 3) form the ends of the block and may also be accessible and visible when the block 1 is grouped together with other blocks as opposed to the side faces 10 and 10' which are neither accessible nor visible.

In accordance with the invention, the internal volume of the terminal block 1 is in the form of a groove such as the groove 13 which, in the example illustrated opens at the top 11' of the block 1 and is disposed longitudinally at the bottom of the block.

However, said configuration is not essential and it could be envisaged to provide such grooves which open out in one, two or three of the walls 11', 12, 12' of the housing or into any other walls forming any angle with said walls 11, 11', 12, 12'.

The groove 13 illustrated in FIG. 1 is arranged so as to allow at least one pusher 2 to slide longitudinally.

This can be done using any conventional means and in particular by providing grooves 20, 20' (FIGS. 1 and 5) and guide rails 14, 14' moulded longitudinally inside the large side faces 10, 10', (FIG. 4), it being understood that it could also be envisaged to dispose the rails and the grooves in an opposite configuration.

A recess is formed at least at one end of a groove 13 to accommodate a connection part 3 of the type which has an insulation-stripping and block slot, in such a manner that said part 3 is held in its recess e.g. because of the matching of its shape with that of its recess.

Figure 7:
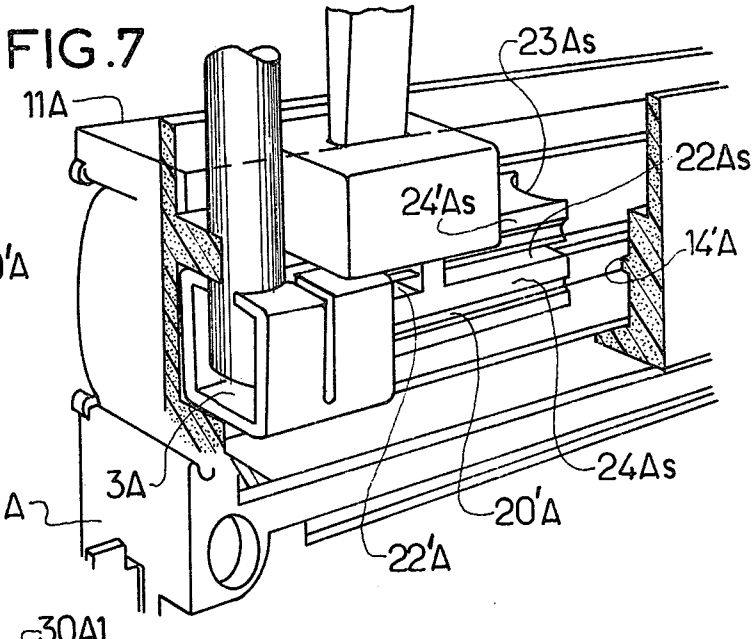
FIGS. 6 and 7 are perspective views as partial cross-sections of a terminal block in accordance with a variant of the invention.

The connection part 3 is a metal part with two lips 30,30' (FIG. 2) which are bevelled along their inlet sides to strip, block and connect as electric wire conductor core as shown in FIG. 7 in a variant of the part 3 such as illustrated in FIG. 1. This conventionally makes it possible to cut the insulation and to engage the conductor core 40 of a wire 4.

The slot defined by the lips 30 and 30' is preferably formed on a plane surface 31 of the connection part 3 and in the mid plane of said part so as to align it with the axis of the groove.

Preferably, the groove 13, the pushing piece 12 and the connection part are symmetrical relative to the longitudinal mid plane of the groove when the terminal block is assembled as illustrated in FIGS. 4 and 5, it being understood that one of the large side faces such as 10' is added and fixed to the body of the terminal block 1 after the connection part and the pusher have been assembled.

In the embodiment illustrated, the connection part 3 is in the form of a section of rectangular tube split longitudinally in its upper portion while its lower portion is extended by a metal strip 31*a*. In the above-mentioned variant, the groove 13 has two connection parts 3 situated at the ends of said groove and the metal strip 31*a* has a central bulge 32 which is formed by folding the strip to make it possible for an optional test pin or equivalent device to be screwed in. This also explains why there are two cheek pieces 16 and 16' which separate the groove 13 into three portions, and two end portions being able to accommodate a pusher 2 while the central portion accommodates the above-mentioned device.

The pusher 2 is designed to be operated from outside the block either by hand or by means of a tool which makes gripping easier. In the embodiment illustrated in FIG. 2, said pusher comes flush with the top or wall 11' of the terminal block and has a slot 21 in which a tool can be inserted as shown in FIG. 1.

The pusher 2 is capable of moving in translation in the groove 13 and has a transversal rectilinear recess 22 on its surface facing the connection part 3. Said recess 22 is slightly wider than the thickness of the plane surface 31 so as to allow partial interpenetration of the pusher 2 into the part 3 when the pusher 2 is moved to its transversal movement end position, in the direction of said part 3.

The pusher 2 also has at least one bent bearing part 23 (FIG. 2) to position the wire which is to be connected; said bearing part 23 is here situated on a projection 24 which projects from the front of the pusher 2 under the recess 22 so as to enter the connection part 3 under the slot defined by the lips 30 and 30', FIG. 3.

Said bearing part 23 is preferably symmetrical relative to the longitudinal mid plane of the groove when the pusher 2 is in place, and its longitudinal axis lies in said plane in such a manner that the wire 4 which it guides lies perpendicular to the plane surface 31 which is itself preferably perpendicular to the longitudinal mid plane of the groove.

Likewise the curved bearing part 23 continues at 23' (FIG. 3) above the recess 22 up to a wire-guiding ring 25 situated in the axis of the curved bearing part so as to lead the wire both during connection and during any disconnection.

Lastly, from the large side faces 10,10' preferably longitudinal ribs 15,15' (FIGS. 2, 3, 4) project outwardly above the plane surface 31 and parallel to the lips 30,30' and being spaced slightly further apart than the lips so as to allow the insulation of the wire 4 to be therebetween inserted and held in place in the same way and at the same time as the conductor core 40 of said wire.

Lastly, the spacing between the curved bearing parts 23, 23' of the pusher 2 is chosen to be sufficiently wide to receive lips 30,30'.

Figure 2:
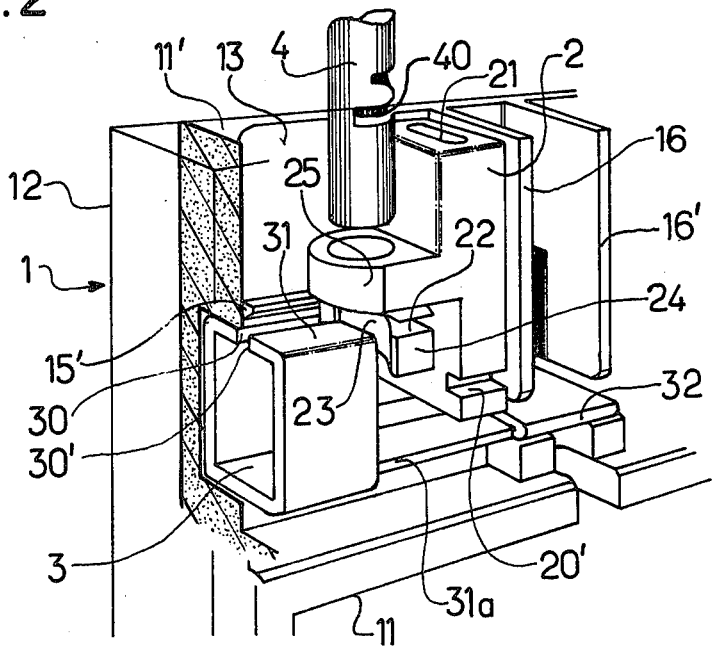

Connecting a wire 4 in accordance with the invention consists in inserting said wire in front of the pusher 2 into the guide ring 25 until its end reaches the strip 31, while the pusher 2 is in its furthest position, then pushing the pusher 2 transversely into its position of partial interpenetration with the connection part 3 as shown in FIG. 1. The insulation of the wire is then cut at the level of the lips 30,30' as shown in FIG. 2. This enables the core 40 of said wire to be connected to the connection part 3 and also to be jammed by the ribs 15 and 15' to hold the wire in place in addition to the action of the lips on the core.

It is also possible to easily remove the wire in case of need by means of the guide ring 25 which entrains the wire 4 when the pusher 2 is brought back to the retracted position.

Figure 6:
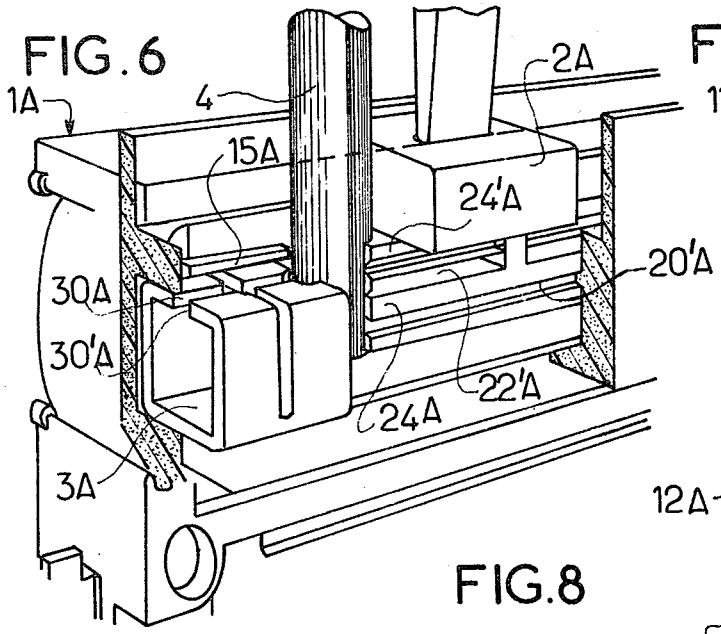

The variant illustrated in FIGS. 6 and 7 resumes the main features and operation of the terminal block illustrated in FIGS. 1 and 2, except that the groove 13A here has only one pusher 2A which is capable of running along the entire length of the grooe and of being used for the two connection parts 3A placed at the ends of said groove. Further, the pusher 2A now has no guide ring since said pusher must be removed from at least one of the parts after connection of a wire.

In the above variant, the same reference numerals are used as in the previous variant, only the letter A being added to distinguish between the two variants.

In a preferred variant of the invention, the connection part 3A is longer than the connection part 3 to allow two wires to be connected by the same part. It must be understood that such a part 3A may optionally be used in a terminal block in accordance with FIG. 1 by replacing the pusher 3 by an assymmetrical pusher 3A.

Except for the fact that there is no guide ring, the pusher 3A differs from the pusher 3 in that it is symmetrical relative to its transversal mid plane and to its longitudinal mid plane whereas the pusher 3 is symmetrical only relative to its longitudinal plane. Further, the projections 24A, 24'A and the projections 24As and 24'As which are symmetrical thereto are longer as a function of the amount by which the parts 3A and 3As are longer than to the symmetrical parts 3 (FIG. 1) and 3.

Further, the part 3A is practically constituted by adding two aligned parts 3 which are then connected together by their base strip 31*a* so as to provide the possibility of connection for two wires whose diameters may be different by means of a single part.

Figure 8:
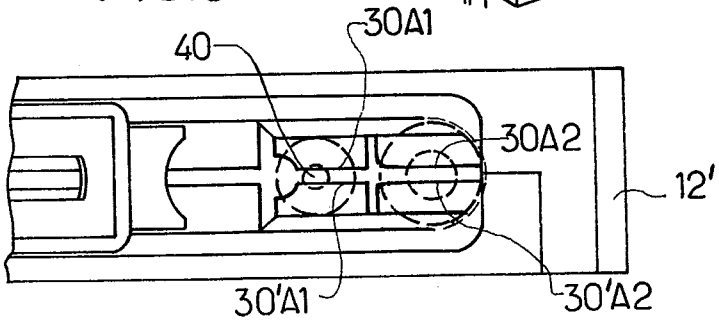
FIG. 8 is a top plan view of a connection part.

With this aim in view the lips 30A and 30'A which form the slot (FIG. 8) are interrupted in their mid portion by an auxiliary slot which runs along three of the four surfaces of the part 3A, thus delimiting two connection units connected together by their base. It must also be understood here that the parts 3A and 3As may optionally be connected to conventional extra connection means without being connected together.

In the embodiment, the lips 30 and 30' at each of the inlets of the slots for connecting a part 3 has a rounded inlet.

This shape is designed:

to allow the positioning of the conductor and keep the insulation in shape during the insertion thrust; and to facilitate cutting the insulation by the pointed portion obtained at the connections between the slots and the rounded inlet portions.

As previously, a first wire is inserted between the pusher 2A and the part 3A and the pusher is manipulated until the first wire is driven into the portion of slot nearest the wall 12 then the pusher is moved back and a second wire is inserted which is pushed into the portion of the slot which is the nearest and is still empty, then the same operation may be carried out with the same pusher 2A in the symmetrical connection part 3As, but on other wires.

We claim:

1. A terminal block for electric connection without stripping, said block comprising a housing (1), at least one conductive connection part (3) fixed within said housing having two laterally spaced opposing lips (30, 30') which form therebetween a blocking and stripping slot open towards the inside of a groove (13) within said housing which contains it and aligned along the longitudinal axis of said groove, the improvement comprising at least one pusher (2) maneuverable from outside the terminal block (1), means for movably mounting said pusher in said groove for movement in translation long the longitudinal axis of the groove between a partial interpenetration position within the blocking and stripping slot and a position which allows the insertion of a suitable wire (4) between the pusher and the slot opening, so as to allow the core of a wire to be inserted by force into the slot when the pusher is brought into the partial interpenetration position under the action of an outside maneuvering force, and said housing having side faces (10, 10') defining said groove with longitudinal ribs provided parallel to and above the lips (30, 30') of the slot and being slightly wider apart than said lips so as to hold the insulation of the wire (4) whose core is held in the slot.

2. A terminal block according to claim 1, wherein the slot of the connection part is formed in a plane portion (31) perpendicular to the longitudinal mid plane of the groove (13) and wherein the surface of the pusher which faces said part has a transversal recess (22) at the same height as said plane portion to allow partial interpenetration of the pusher with the part.

3. A terminal block according to claim 2, wherein the pusher has at least one curved portion (23) which ensures the positioning of the wire perpendicularly to the plane portion (31) and facing said slot.

4. A terminal block according to claim 2, wherein the groove has a connection part (3) at each end and said at least one pusher comprises a pusher (2) per part, the two pushers being separated from each other by cheek pieces (14, 14') of the terminal block housing (1) which are perpendicular to the longitudinal mid plane of the housing groove (13) and which provide a passage between them which runs towards the end of the groove.

5. A terminal block according to claim 2, wherein the housing groove has a connection part (3A, 3As) at each end and a single pusher 2A is disposed in said housing groove and is symmetrical relative to its transversal mid plane.

6. A terminal block according to claim 2, characterized in that each lip (30, 30') defining the slot of a connection part (3A) is divided into two portions (30A1, 30'A1 and 30A2 and 30'A2) by an auxiliary slot and wherein the two lip portions (30A1, 30'A1) close to the pusher (2A) have a rounded concave portion near said pusher whereas the portions (30A2, 30A'2) which are the furthest from the pusher have a convex portion in the direction of said pusher so as to allow prior positioning of the insulation of the wires before insertion and to allow the connection of two different wires by means of the connection part (3A).

7. A terminal block according to claim 3, wherein said curved bearing part (23) is positioned under the transversal recess (22) and in front of it and wherein a prominence (24) bears said recess and is engaged under the slot in the interpenetration position of the connection part and of the pusher.

* * * * *